US011242200B2

(12) United States Patent
Hopper

(10) Patent No.: US 11,242,200 B2
(45) Date of Patent: Feb. 8, 2022

(54) SWINGING DOOR GARBAGE CAN APPARATUS

(71) Applicant: Keith Hopper, Athens, GA (US)

(72) Inventor: Keith Hopper, Athens, GA (US)

( * ) Notice: Subject to any disclaimer, the term of this patent is extended or adjusted under 35 U.S.C. 154(b) by 260 days.

(21) Appl. No.: 16/527,564

(22) Filed: Jul. 31, 2019

(65) Prior Publication Data

US 2021/0032021 A1 Feb. 4, 2021

(51) Int. Cl.

| | |
|---|---|
| ***B65D 25/14*** | (2006.01) |
| ***B65F 1/14*** | (2006.01) |
| ***B65F 1/06*** | (2006.01) |
| ***B65F 1/16*** | (2006.01) |

(52) U.S. Cl.

CPC ..... *B65F 1/1426* (2013.01); *B65F 1/068* (2013.01); *B65F 1/16* (2013.01); *B65F 2210/148* (2013.01)

(58) Field of Classification Search

CPC ..... B65F 1/1426; B65F 1/068; B65F 1/16; B65F 1/1515; B65F 2210/148; B65D 45/16

USPC ..... 220/495.06, 908, 4.22, 4.23

See application file for complete search history.

(56) References Cited

U.S. PATENT DOCUMENTS 2,624,451 A * 1/1953 Ewing ..... A47J 39/00 206/541
4,923,080 A * 5/1990 Lounsbury ..... B65F 1/06 220/324
4,955,497 A * 9/1990 Winden ..... B65F 1/08 220/210
5,984,134 A 11/1999 Mario
6,732,880 B1 * 5/2004 Nash, Sr. ..... B65F 1/02 220/4.22
2003/0006237 A1 1/2003 Passantino
2007/0273257 A1 * 11/2007 Hui ..... B65F 1/1442 312/274
2008/0149647 A1 6/2008 Geurink
2009/0071963 A1 * 3/2009 Johnson ..... B65F 1/141 220/476
2010/0219191 A1 * 9/2010 Prosa ..... B65F 1/1436 220/495.06
2014/0246439 A1 9/2014 Friedman
2014/0339226 A1 11/2014 Edwards
2015/0375934 A1 * 12/2015 Reiser ..... B65F 1/068 53/474

FOREIGN PATENT DOCUMENTS

DE 9212325 * 12/1992 ..... B65F 1/1607

* cited by examiner

*Primary Examiner* — Don M Anderson
*Assistant Examiner* — Elizabeth J Volz

(57) ABSTRACT

A swinging door garbage can apparatus for easy garbage bag removal includes a base comprising a vertical base wall. A can body has a can door is coupled to the can body. The can door has a hinge coupled to the can sidewall. The can door swiningly moves from a closed position extending and an alternate open position exposing a can inside. A shelf is coupled to a door inner face of the can door. A panel track is coupled to the door inner face. A locking panel is coupled to the door inner face and slidably engages within the panel track. The locking panel has a plurality of locking pins. The plurality of locking pins is selectively engageable with a plurality of pin receptacles coupled to the can body to secure the can door in the closed position.

14 Claims, 5 Drawing Sheets

SWINGING DOOR GARBAGE CAN APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to garbage cans and more particularly pertains to a new garbage can for easy garbage bag removal.

BRIEF SUMMARY OF THE INVENTION

An embodiment of the disclosure meets the needs presented above by generally comprising a base comprising a vertical base wall. A can body has a can bottom side and a can sidewall perpendicularly extending from a can left side, a can front side, and a can right side of the can bottom side to form a can inside. A can door is coupled to the can body. The can door has a hinge coupled to a left edge of the can sidewall. The can door swiningly moves from a closed position extending from the left edge to a right edge of the sidewall and an alternate open position exposing the can inside. A shelf is coupled to a door inner face of the can door adjacent a door bottom edge of the can door. The shelf conforms to the can bottom side and rests above the can bottom side with the can door in the closed position. A plurality of pin receptacles is coupled to the can body. The plurality of pin receptacles is coupled to the can sidewall adjacent the right edge. A panel track is coupled to the door inner face. A locking panel is coupled to the door inner face and slidably engages within the panel track. The locking panel has a plurality of locking pins. The plurality of locking pins is selectively engageable with the plurality of pin receptacles to secure the can door in the closed position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
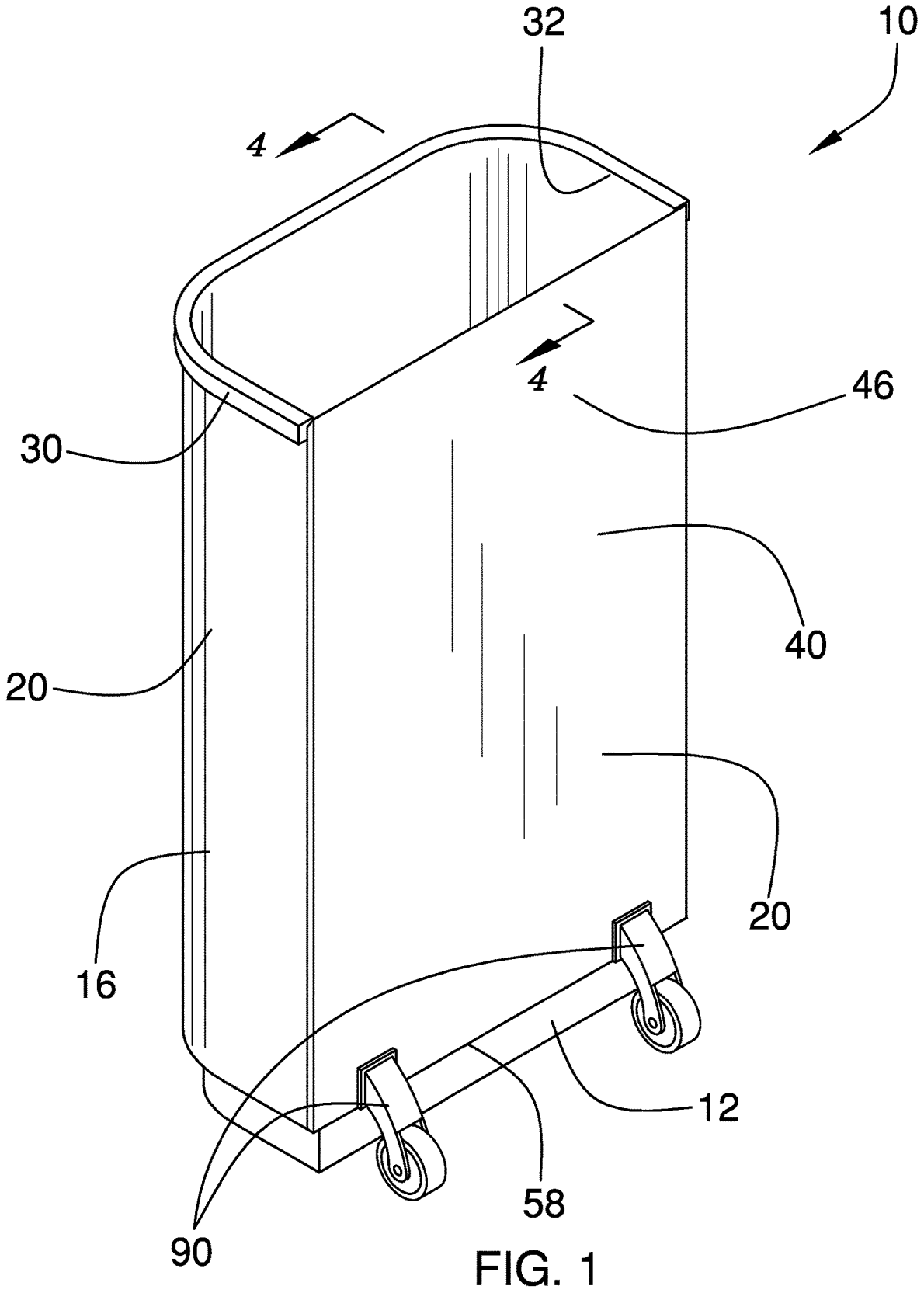
FIG. 1 is an isometric view of a swinging door garbage can apparatus according to an embodiment of the disclosure.
Figure 2:
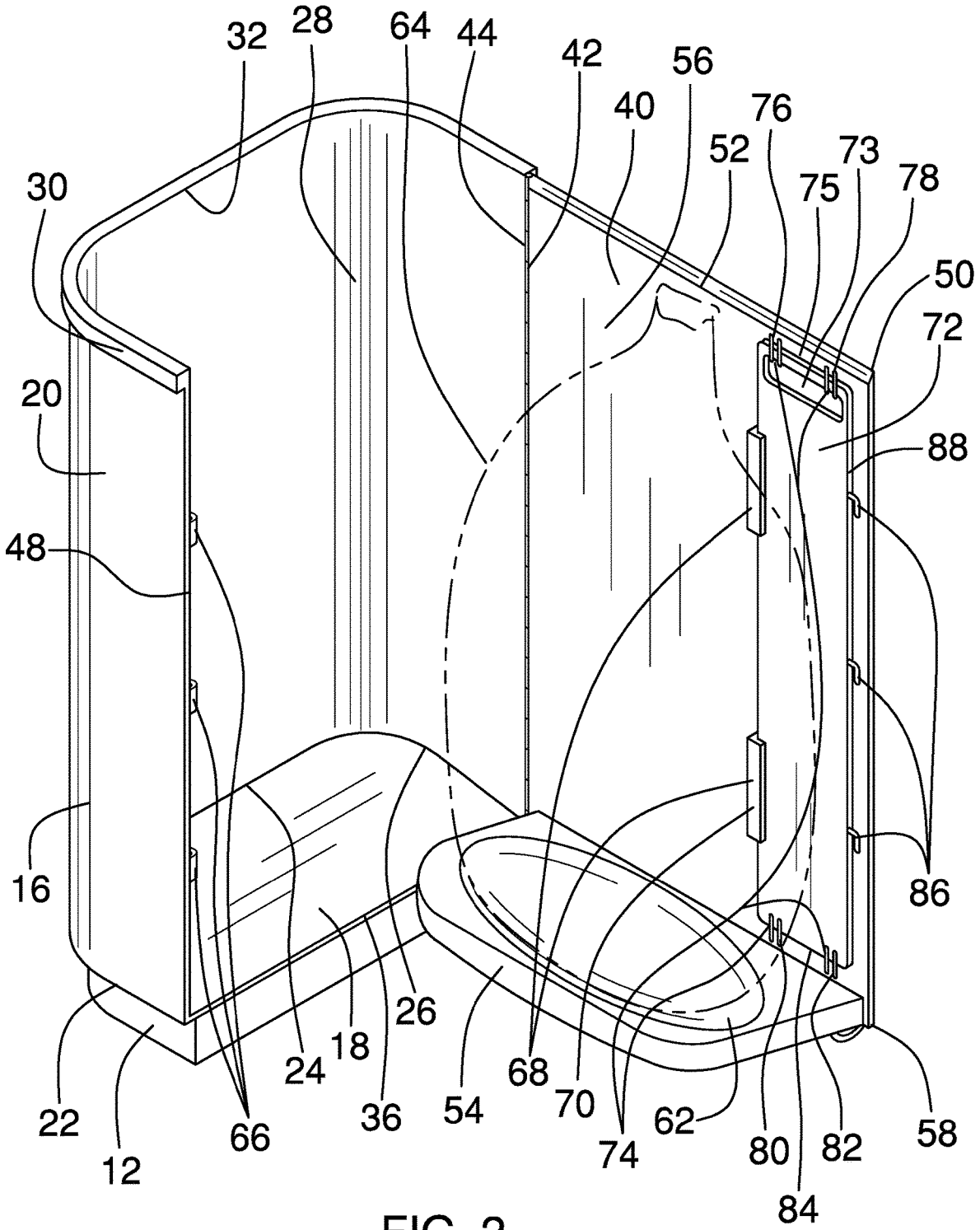
FIG. 2 is an isometric view of an embodiment of the disclosure.
Figure 3:
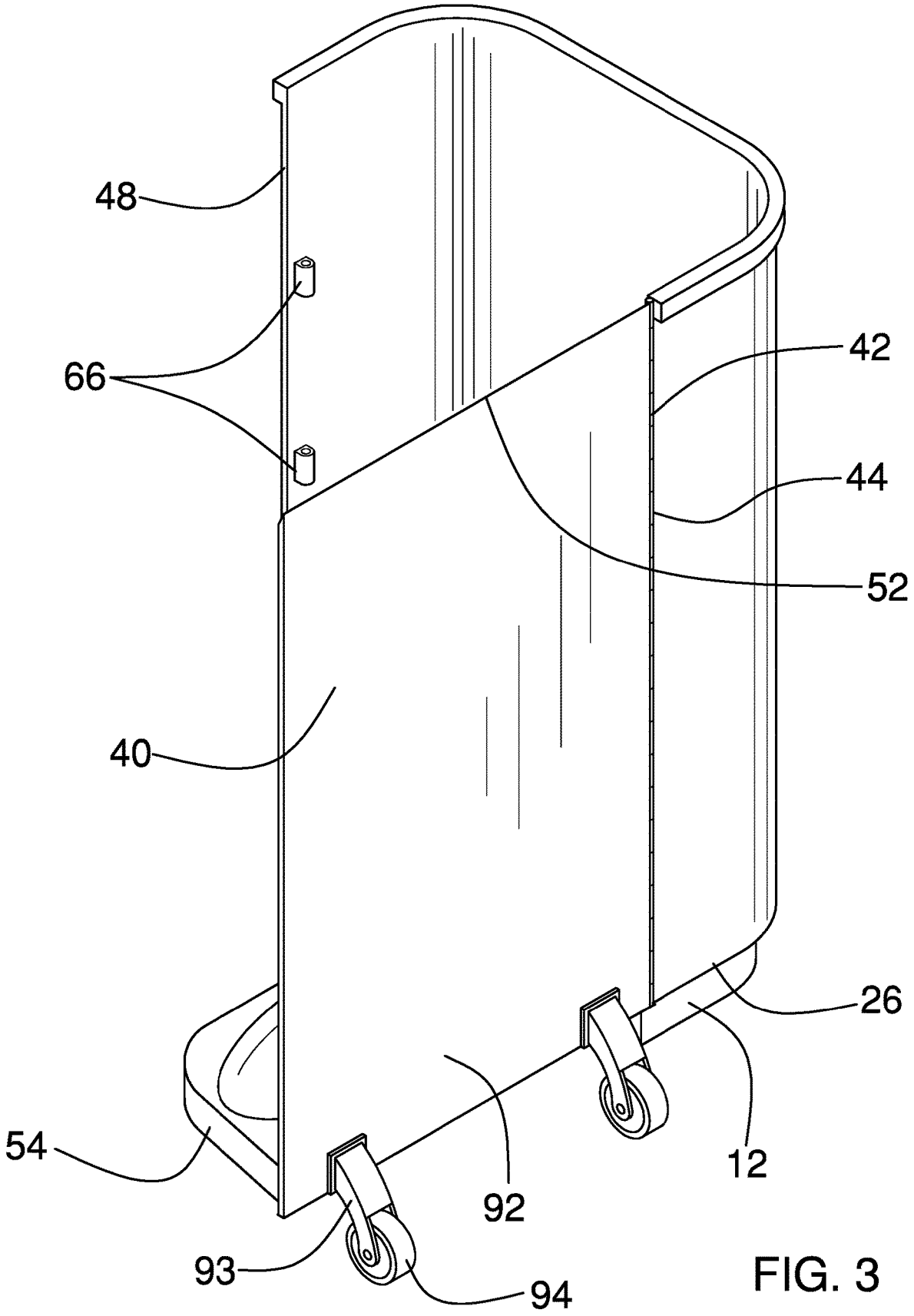
FIG. 3 is an isometric view of an embodiment of the disclosure.
Figure 4:
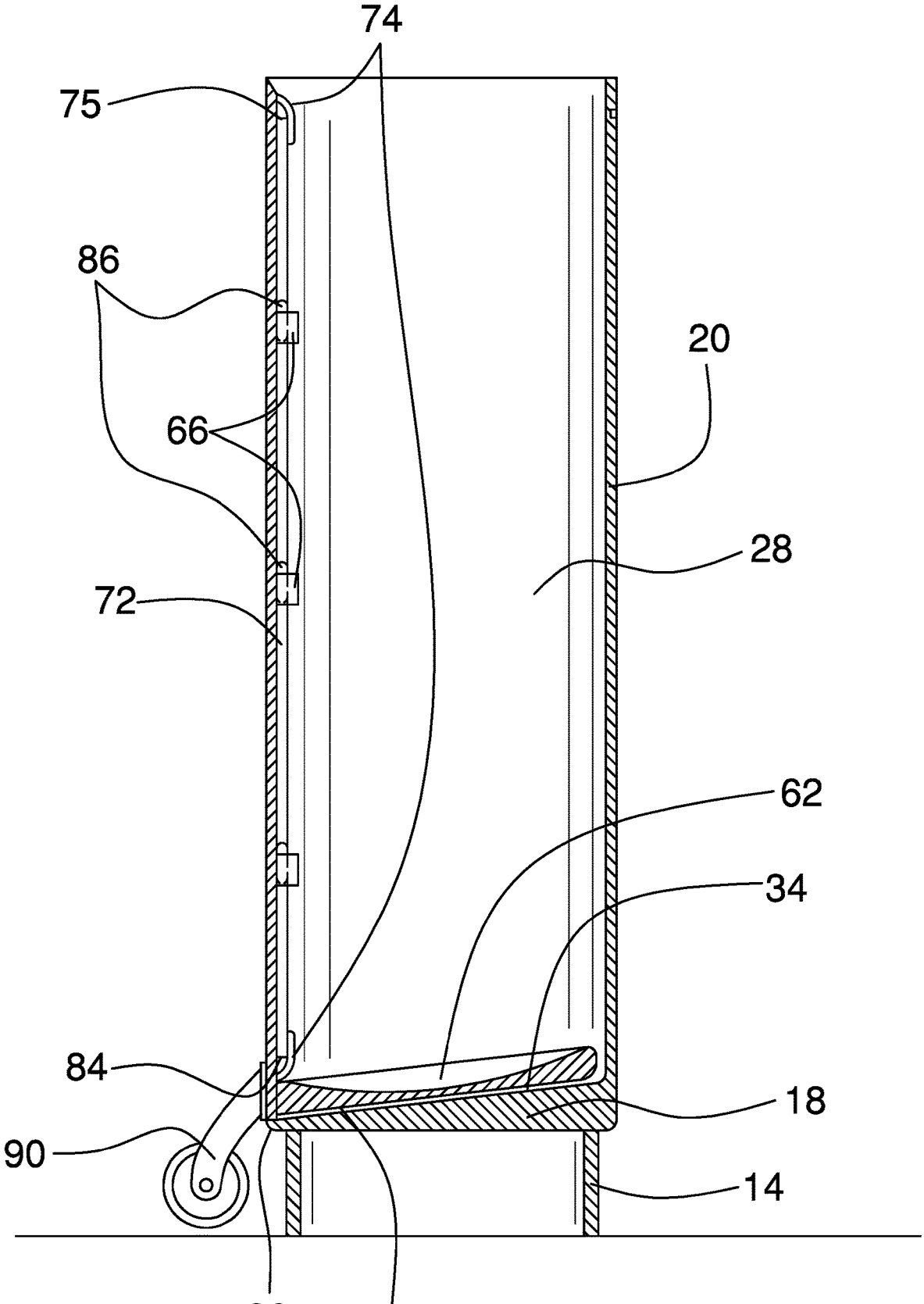
FIG. 4 is a cross-sectional view along line 4-4 of FIG. 1 an embodiment of the disclosure.
Figure 5:
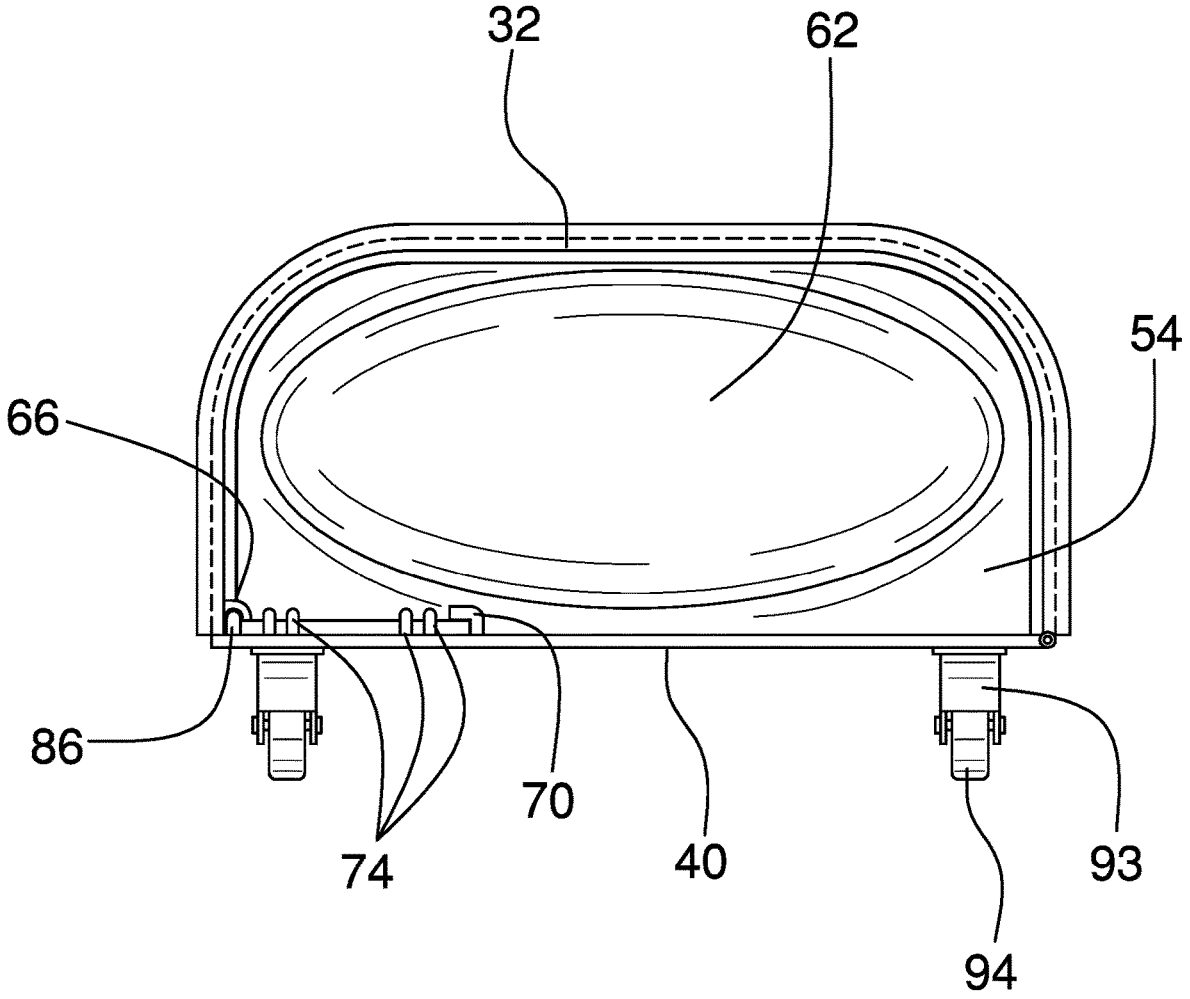
FIG. 5 is a top plan view of an embodiment of the disclosure.

With reference now to the drawings, and in particular to FIGS. 1 through 5 thereof, a new garbage can embodying the principles and concepts of an embodiment of the disclosure and generally designated by the reference numeral 10 will be described.

As best illustrated in FIGS. 1 through 5, the swinging door garbage can apparatus 10 generally comprises a base 12 comprising a vertical base wall 14. A can body 16 has a can bottom side 18 and a can sidewall 20 perpendicularly extending from a can left side 22, a can front side 24, and a can right side 26 of the can bottom side 18 to form a can inside 28. A rim 30 extends from a can upper edge 32 of the can sidewall 20. A can upper face 34 of the can bottom side 18 is angled from a can back edge 36 of the can bottom side 18 up towards the can front side 24. The can bottom side 18 is rounded between the can left side 22 and the can front side 24 and between the can right side 26 and the can front side 24. The can sidewall 20 conforms to the curvature of the can bottom side 18. A shape of the can bottom side 18 is proportionally larger than a shape of the base 12.

A can door 40 is coupled to the can body 16. The can door 40 has a hinge 42 coupled to a left edge 44 of the can sidewall 20. The can door 40 swiningly moves from a closed position 46 extending from the left edge 44 to a right edge 48 of the sidewall 20 and an alternate open position 50 exposing the can inside 28. A door top edge 52 of the can door 40 is beveled. A shelf 54 is coupled to a door inner face 56 of the can door 40 adjacent a door bottom edge 58 of the can door 40. The shelf 54 is coupled at an angle and conforms to the can bottom side 18. The shelf 54 rests above the can bottom side 18 with the can door 40 in the closed position 46. A shelf upper face 60 of the shelf 54 has an ovular depression 62. The ovular depression 62 is configured to support a trash bag 64.

A plurality of pin receptacles 66 is coupled to the can body 16. The plurality of pin receptacles 66 is coupled to the can sidewall 20 adjacent the right edge 48. Each of the plurality of pin receptacles 66 is a vertical tubular shape. A panel track 68 is coupled to the can door 40 and comprises a pair of vertical angled brackets 70 coupled to the door inner face 56. A locking panel 72 is coupled to the door inner face 56 and is slidably engageable within the panel track 68. The locking panel 72 extends from proximal the shelf 54 to proximal a door top edge of the can door 40. The locking panel 72 has a handle cutout 73 proximal a panel top edge 75 of the locking panel 72. The locking panel 72 has a plurality of elastic cords 74 coupled to the door inner face 56 allowing a limited vertical translational motion within the panel track 68. The plurality of elastic cords 74 comprises a top left pair of cords 76 and a top right pair of cords 78 coupled from the handle cutout 73 to the panel top edge 75 and a bottom left pair of cords 80 and a bottom right pair of cords 82 coupled adjacent a panel bottom edge 84 of the locking panel 72. The locking panel 72 has a plurality of locking pins 86. Each of the plurality of locking pins 86 may be a 90° elbow extending away and down from a panel outer edge 88 of the locking panel 72. The plurality of locking pins 86 is selectively engageable with the plurality of pin receptacles 66 to secure the can door 40 in the closed position 46. A pair of rollers 90 is coupled to a door outer face 92 of the can door 40 adjacent the door bottom edge 58 to support the weight of the trash bag 64 with the can door 40 in the open position 50. Each of the pair of rollers 90 has a curved arm 93 extending away from the can door 40 and a wheel 94 coupled to the curved arm 93.

In use, the user loads a trash bag 64 onto the shelf 54 within the can inside 28. Trash is placed in the trash bag 64 until it is filled and the can door 40 is moved to the open position 50 to remove the trash bag 64. The apparatus 10 may be arranged with the can door 40 on the ground to use the beveled door top edge 52 as a dust pan.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A swinging door garbage can apparatus comprising:

a base, the base comprising a vertical base wall;

a can body, the can body having a can bottom side and a can sidewall perpendicularly extending from a can left side, a can front side, and a can right side of the can bottom side to form a can inside;

a can door coupled to the can body, the can door having a hinge coupled to a left edge of the can sidewall, the can door swinging from a closed position extending from the left edge to a right edge of the sidewall and an alternate open position exposing the can inside;

a shelf coupled to the can door, the shelf being coupled to a door inner face of the can door adjacent a door bottom edge of the can door, the shelf conforming to the can bottom side and resting above the can bottom side with the can door in the closed position;

a plurality of pin receptacles coupled to the can body, the plurality of pin receptacles being coupled to the can sidewall adjacent the right edge;

a panel track coupled to the can door, the panel track being coupled to the door inner face; and a locking panel coupled to the can door, the locking panel being coupled to the door inner face and slidably engageable within the panel track, the locking panel having a plurality of locking pins, the plurality of locking pins being selectively engageable with the plurality of pin receptacles to secure the can door in the closed position.

2. The swinging door garbage can apparatus of claim 1 further comprising a can upper face of the can bottom side being angled from a can back edge of the can bottom side up towards the can front side, the shelf being coupled at an angle to accommodate the angle of the can bottom side.

3. The swinging door garbage can apparatus of claim 1 further comprising a shelf upper face of the shelf having an ovular depression, the ovular depression being configured to support a trash bag.

4. The swinging door garbage can apparatus of claim 1 further comprising a pair of rollers coupled to the can door, the pair of rollers being coupled to a door outer face of the can door adjacent the door bottom edge.

5. The swinging door garbage can apparatus of claim 4 further comprising each of the pair of rollers having a curved arm extending away from the can door and a wheel coupled to the curved arm.

6. The swinging door garbage can apparatus of claim 1 further comprising the can bottom side being rounded between the can left side and the can front side and between the can right side and the can front side, the can sidewall conforming to the curvature of the can bottom side.

7. The swinging door garbage can apparatus of claim 6 further comprising a shape of the can bottom side being proportionally larger than a shape of the base.

8. The swinging door garbage can apparatus of claim 1 further comprising the panel track comprising a pair of vertical angled brackets.

9. The swinging door garbage can apparatus of claim 8 thither comprising the locking panel extending from proximal the shelf to proximal a door top edge of the can door, the locking panel having a handle cutout proximal a panel top edge of the locking panel, the locking panel having a plurality of elastic cords coupled to the door inner face allowing a limited vertical translational motion within the panel track.

10. The swinging door garbage can apparatus of claim 9 further comprising each of the plurality of locking pins each being a 90° elbow extending away and down from a panel outer edge of the locking panel, each of the plurality of pin receptacles being a vertical tubular shape.

11. The swinging door garbage can apparatus of claim 9 further comprising the plurality of elastic cords comprising a top left pair of cords and a top right pair of cords coupled from the handle cutout to the panel top edge and a bottom left pair of cords and a bottom right pair of cords coupled adjacent a panel bottom edge of the locking panel.

12. The swinging door garbage can apparatus of claim 1 further comprising a door top edge of the can door being beveled.

13. The swinging door garbage can apparatus of claim 1 further comprising a rim extending from a can upper edge of the can sidewall.

14. A swinging door garbage can apparatus comprising:

a base, the base comprising a vertical base wall;

a can body, the can body having a can bottom side and a can sidewall perpendicularly extending from a can left side, a can front side, and a can right side of the can bottom side to form a can inside, a rim extending from a can upper edge of the can sidewall, a can upper face of the can bottom side being angled from a can back edge of the can bottom side up towards the can front side, the can bottom side being rounded between the can left side and the can front side and between the can right side and the can front side, the can sidewall conforming to the curvature of the can bottom side, a shape of the can bottom side being proportionally larger than a shape of the base;

a can door coupled to the can body, the can door having a hinge coupled to a left edge of the can sidewall, the can door swinging from a closed position extending from the left edge to a right edge of the sidewall and an alternate open position exposing the can inside, a door top edge of the can door being beveled;

a shelf coupled to the can door, the shelf being coupled to a door inner face of the can door adjacent a door bottom edge of the can door, the shelf being coupled at an angle and conforming to the can bottom side, the shelf resting above the can bottom side with the can door in the closed position, a shelf upper face of the shelf having an ovular depression, the ovular depression being configured to support a trash bag;

a plurality of pin receptacles coupled to the can body, the plurality of pin receptacles being coupled to the can sidewall adjacent the right edge, each of the plurality of pin receptacles being a vertical tubular shape;

a panel track coupled to the can door, the panel track comprising a pair of vertical angled brackets coupled to the door inner face;

a locking panel coupled to the can door, the locking panel being coupled to the door inner face and slidably engageable within the panel track, the locking panel extending from proximal the shelf to proximal a door top edge of the can door, the locking panel having a handle cutout proximal a panel top edge of the locking panel, the locking panel having a plurality of elastic cords coupled to the door inner face allowing a limited vertical translational motion within the panel track, the plurality of elastic cords comprising a top left pair of cords and a top right pair of cords coupled from the handle cutout to the panel top edge and a bottom left pair of cords and a bottom right pair of cords coupled adjacent a panel bottom edge of the locking panel, the locking panel having a plurality of locking pins, each of the plurality of locking pins being a 90° elbow extending away and down from a panel outer edge of the locking panel, the plurality of locking pins being selectively engageable with the plurality of pin receptacles to secure the can door in the closed position; and a pair of rollers coupled to the can door, the pair of rollers being coupled to a door outer face of the can door adjacent the door bottom edge, each of the pair of rollers having a curved arm extending away from the can door and a wheel coupled to the curved arm.

* * * * *